United States Patent [19]

Vanderjagt

[11] 4,253,804

[45] Mar. 3, 1981

[54] DOUBLE ACTION HAND PUMP STRUCTURE

[76] Inventor: John A. Vanderjagt, 1395 Glen Oaks, Memphis, Tenn. 38117

[21] Appl. No.: 33,198

[22] Filed: Apr. 25, 1979

[51] Int. Cl.[3] ..... G05G 1/20; F04B 39/00

[52] U.S. Cl. ..... 417/534; 74/491; 74/523

[58] Field of Search ..... 417/534, 537; 60/479, 60/480; 74/491, 523

[56] References Cited

U.S. PATENT DOCUMENTS

| | | | |
|---|---|---|---|
| 1,482,256 | 1/1924 | Drall | 60/480 |
| 1,775,975 | 9/1930 | Swainson | 417/534 |
| 2,843,051 | 7/1958 | Allen | 417/534 |
| 2,845,033 | 7/1958 | Wright | 417/535 |
| 3,530,771 | 9/1970 | Bowman | 60/479 |
| 4,048,800 | 9/1977 | Cancilla | 60/482 |

FOREIGN PATENT DOCUMENTS

| | | | |
|---|---|---|---|
| 612225 | 10/1926 | France | 417/536 |
| 551396 | 2/1943 | United Kingdom | 417/534 |

*Primary Examiner*—William L. Freeh
*Attorney, Agent, or Firm*—Walker & McKenzie

[57] ABSTRACT

A linkage arrangement which minimizes wear in coupling a hand operated lever to a piston or diaphragm type fuel transfer pump. The arrangement includes U-shaped pin structure which establishes a pair of pivot pins about which may respectfully freely pivot (1) a reciprocating pump action rod, and (2) one end of elongated linkage structure, i.e., as the hand operated lever is operated. Although, relative pivotal movement between the lever and the pair of pivot pins is absolutely impossible even though the pin structure is freely received in aligned apertures provided in the lever, the rod and the linkage structure, thereby substantially eliminating any wear of the lever per se, i.e., particularly adjacent the pivot points thereof and eliminating wear on the pivot pins which would otherwise be caused by relative movement between the parts.

4 Claims, 6 Drawing Figures

DOUBLE ACTION HAND PUMP STRUCTURE

BACKGROUND OF THE INVENTION

1. Field of the Invention

This invention relates to piston type and/or diaphragm type hand operated double acting liquid or fuel transfer pumps and the like.

2. Description of the Prior Art

It is well recognized in the industry that in order to remain competitive from a cost basis, it is often necessary to avoid incorporating elaborate or expensive features which, although, might be advantageous from a durability standpoint, the cost thereof can not be justified. For example, it is well known that friction creates wear particularly between two moving parts. Therefore, in order to eliminate or at least minimize friction, bearing assemblies, i.e., roller bearings, ball bearings and sleeve bearings and the like, may be incorporated when it is highly desirable to minimize friction. Of course, the more elaborate or sophisticated a product becomes, the greater is the cost thereof, which in many cases adversely affects the sales volume thereof. Accordingly, the secret of a successful product oftentimes lies in the simplicity in the construction thereof. Of course, the consumer still demands a certain degree of reliability and durability for the product purchased, therein lies the main objective of the present invention.

Heretofore, pumps of the type herein disclosed usually incorporated floated pivot pin structure for coupling the lever like hand operated lever or handle to the reciprocatable rod which actuates the piston in piston type pumps or the diaphragm in diaphragm type pumps, i.e., the floating pin is free to revolve in both the reciprocating rod and the lever. This arrangement has proven to have several disadvantages which invariably lead to premature failure of the pump. More specifically, the prevailing problem involves undue wear of the pivot pin structure or of the handle or lever in the vicinity immediately about the pivot pin structure. Many of the failures resulted from deep grooves being worn in the pivot pin structure until the pin structure broke at the groove or grooves. Of course, the obvious solution to this problem would be to incorporate any of the above mentioned types of friction reducing bearings for receiving the pin structure, however, the cost of such an arrangement can not be fully justified. Therefore, the industry has learned to live with this drawback by simple overhauling or oftentimes replacing these type pumps.

Accordingly, a need exists for an improvement of this coupling arrangement which minimizes wear of the handle or lever. However, the solution must reside in simplicity and ease of construction and assembly, thus minimizing the overall cost in order to remain competitive.

SUMMARY OF THE INVENTION

The present invention is directed towards overcoming the problems and disadvantages of prior hand operated liquid transfer pumps, particularly the problem involving undue wear of the handle or lever in the area adjacent the pivot pin structure used in coupling the lever to the reciprocating rod. The linkage or coupling arrangement herein disclosed drastically reduces or minimizes wear in coupling a hand operated lever or handle to a reciprocatable rod associated with a double acting piston type or diaphragm type hand operated liquid, i.e., fuel and the like, transfer pump. In fact, the structure herein disclosed substantially eliminates the problem outlined above which pertains to undue wear of the handle or lever in the vicinity of the pivot pin structure. Moreover, the significance of the present invention is that these type pumps may now be more durable requiring little or no maintenance during a more prolonged life thereof while at the same time implementation of the concept does not increase the production cost.

The arrangement includes U-shaped pin structure which establishes a pair of parallel spaced apart pin members about which may respectfully freely pivot (1) a reciprocating pump action rod and (2) one end of elongated linkage structure, i.e., as the hand operated lever is operated. The elongated linkage structure preferably comprises a pair of parallel spaced apart link members disposed on either side of the handle or lever and having one of the ends thereof pivotally attached to the U-shaped pin structure while the remote ends thereof are pivotally attached in any typical fashion to the pump housing.

Relative pivotal movement between the lever and the pair of pivot pin members is absolutely impossible even though the pin structure is freely received in aligned apertures provided in (1) the lever, (2) the rod, and (3) the linkage structure, thereby substantially eliminating any wear of the lever or the pivot members where they contact one another. The term "freely received" will be defined later in the specification. Stated another way, the pivotal movement is restricted at the one pivot point so as to exist merely about the mid portion of the one pivot pin member and its complimentary reciprocating rod. Also, pivotal movement at the other pivot point, is restricted so as to exist merely about the remote or the outer ends of the other pivot pin member and its complimentary elongated linkage members.

Another feature of the present invention resides in the construction of the individual elongated link members. Moreover, the apertures provided in the lever end of these elongated link members are established by an "upset" technique. Thus, this forms a bearing surface for engagement with the outer ends of the pivot pin member which has a greater dimensional thickness than does the remaining portion of the link member.

DESCRIPTION OF THE PREFERRED EMBODIMENT

Figure 5:
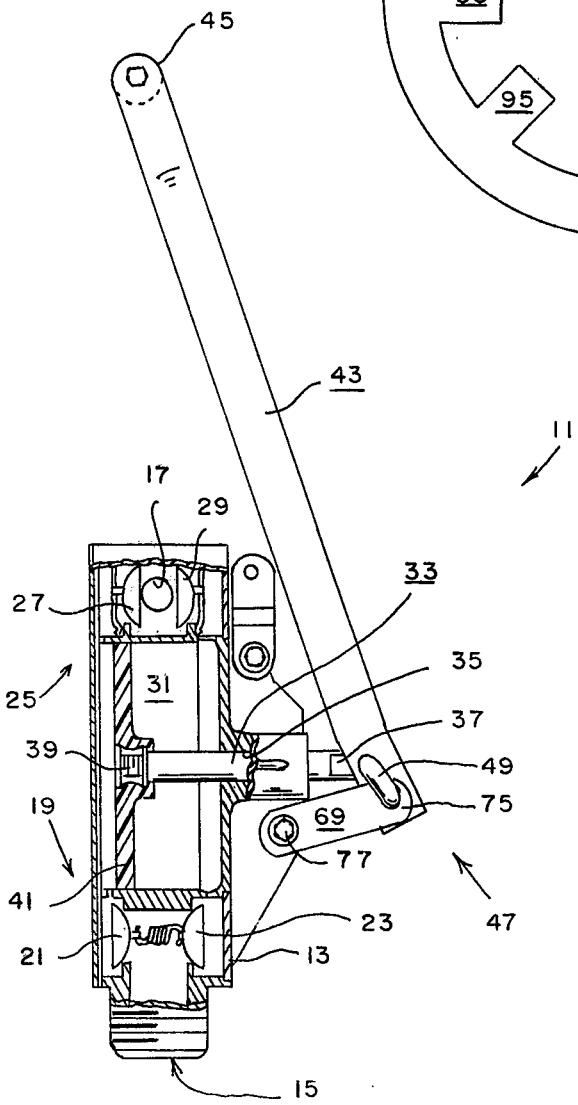
FIG. 5 is a partial sectional view of the complete pump of the present invention with the view being taken as on a vertical plane through the center line of the assembly and certain structure thereof not being sectionalized for clarity.

The hand operated pump 11 of the present invention is normally used in liquid transfer (fuel and the like) and is of the double acting type having a housing 13 provided with inlet and outlet ports 15, 17 as thus shown in FIG. 5 of the drawings. Further, it may readily be seen that the pump 11 includes a double acting inlet check valve means, as at 19, having a pair of flapper members 21, 23 arranged in a typical manner and disposed within the housing 13 adjacent the inlet port 15. Also, the pump 11 includes a double acting outlet check valve means, as at 25, having a pair of flapper members 27, 29 disposed within the housing 13 adjacent to the outlet port 17 and arranged therein in a typical fashion. It will be appreciated by those skilled in the art that since the inlet and outlet check valve means 19, 25 are typical construction and are not a part of the present invention, no attempt will herein be made to further expound upon them.

The housing 13 defines an inner chamber, as at 31, which is interposed between the inlet and outlet check valve means 19, 25. A reciprocatable rod 33 is included and extends through an aperture 35 provided in the housing 13 and which includes an outer end, as at 37, disposed on the exterior of the housing 13 and an inner end, as at 39, reaching into the inner chamber 31.

It will also be appreciated by those skilled in the art that the present invention is directed toward both piston type hand operated pump and diaphragm type hand operated pump. These two pumps differ only slightly one from the other in that, as the term implies, one has a slidable piston which urges the fuel outwardly while the other has a flexible diaphragm which urges the fuel outerwardly, i.e., through the outlet port 17. Accordingly, the pump 11 includes means, e.g., a piston 41, attached to the inner end 39 of the reciprocatable rod 33 for alternately varing the effective volume of the chamber 31 as the reciprocatable rod 33 is caused to reciprocate so as to cause the liquid (not shown) container within the chamber 31 to be forced outwardly from the outlet port 17. Of course, a diaphragm arrangement could readily be incorporated within the chamber 31 in lieu of the piston 41, thus the present invention is not intended to be limited to a piston type hand pump.

Figure 1:
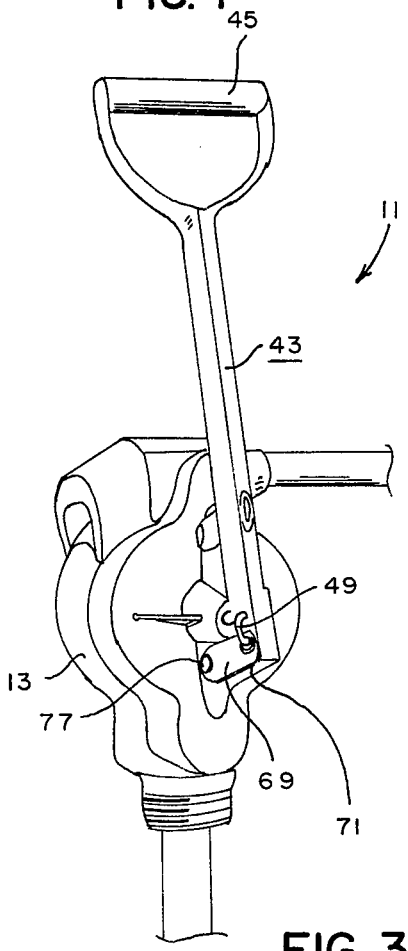
FIG. 1 is a perspective view of the improved pump of the present invention.

The pump 11 also includes lever means, as at 43, which is adapted to be manually grasped when operating the pump 11, i.e., a handle 45 as thus shown in FIG. 1 of the drawings is provided for this purpose.

Figure 2:
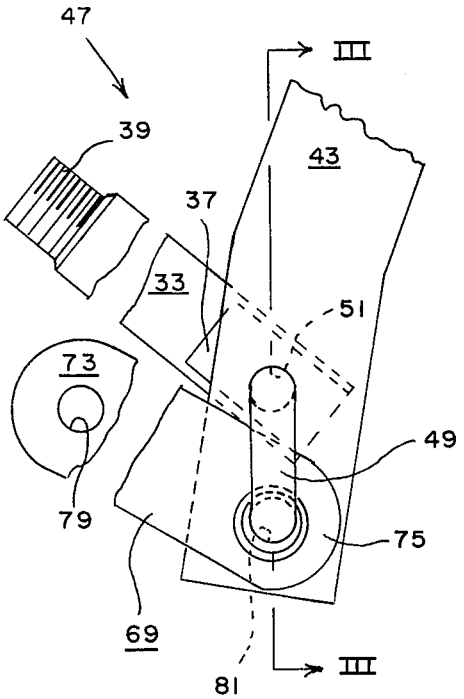
FIG. 2 is an enlarged partial view of a disassembled portion of the pump showing the structure involved in the linkage arrangement of the present invention.

Particular attention is now directed to FIGS. 2 and 3 of the drawings which depict an important feature of the present invention or linkage means generally indicated at 47 for coupling the lever means to (1) the housing 13 in a manner to be disclosed below, and (2) to the outer end 37 of the reciprocatable rod 33. The linkage means 47 alluded to above includes pin means generally indicated at 49 about which the outer end 37 of the reciprocatable rod 33 is free to pivot and including means for precluding relative pivotal movement between the lever means 43 and the pin means 49. The pin means 49 is freely received in aligned rod apertures, as at 51, 53, 55 respectively provided in the outer end 37 of the reciprocatable rod 33 and the lever means 43, i.e., the lever means 43 preferably is constructed of elongated channel like structure having a pair of parallel spaced apart flange members 57, 59 joined by a web member 61 with the apertures 53, 55 respectively being provided in the flange members 57, 59. The term "freely received" as used above is herein intended to mean the pin means 49 is simply slipped through the apertures 51, 53, 55 as opposed to being press fitted in place or welded in place and the like.

Figure 3:
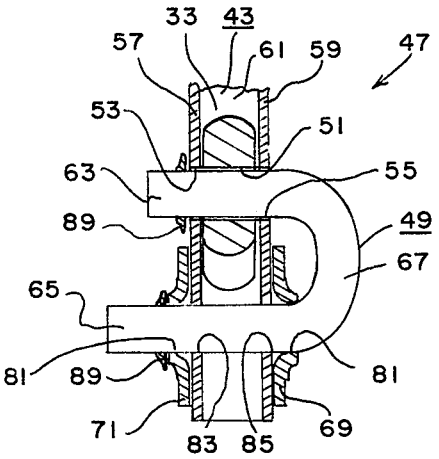
FIG. 3 is an enlarged sectional view taken as on the line III—III of FIG. 2.

From FIG. 3 of the drawings it may clearly be seen that the pin means 49 includes first and second parallel spaced apart pin members 63, 65 rigidly fixed one with the other in any well known manner, e.g., as being integrally formed from a single piece of bar stock which is circular in cross-section so as to establish an intermediate member 67 when suitably bent substantially to the shape as shown in FIG. 3.

Further, it may be seen that the first pin member 63 is "freely received" through the rod apertures 53, 55 provided in the lever means 43 and the rod aperture 51 provided in the reciprocatable rod 33, thus the rod 33 is pivotally attached to the lever means 43.

The linkage means 47 also includes at least one but preferably a pair of elongated plate-like link members, as at 69, 71 as shown in FIGS. 1 and 3 of the drawings. It should be understood that since the link members 69, 71 are identical one with the other, a complete description of the link member 69 as shown in FIG. 2 will be intended to encompass the link member 71. Therefore, the link member 69 includes distal and proximal ends 73, 75 and the distal end 73 is pivotally attached to the housing 13 as with a pivot pin 77 (FIGS. 1, 5) which freely extends through suitable apertures, as at 79, i.e., the housing 13 is also provided with an aperture (not shown) which may be aligned with the aperture 79 for receiving the pivot pin 77.

The proximal end 75 of the link member 69 is provided with a link aperture, as at 81 for pivotally receiving the second pin member 65 of the pin means 49. Additionally, the lever means 43 is provided with a pair of link apertures 83, 85, i.e., respectively provided in the flange members 57, 59 thereof, for receiving the second pin member 65 of the pin means 49. Thus, either end of the link member 69 is free to pivot while pivotal movement of the lever means 43 relative to the pin means 49 remains absolutely impossible. The first pin member 63 of the pin means 49 is "freely received" in the rod apertures 53, 55 of the lever means 43 and the rod aperture 51 provided in the reciprocatable rod 33. Also, the second pin member 65 of the pin means 49 is "freely received" in the link apertures 83, 85 of the lever means 43 and the link apertures 81, 81' provided in the link members 69, 71.

Figure 4:
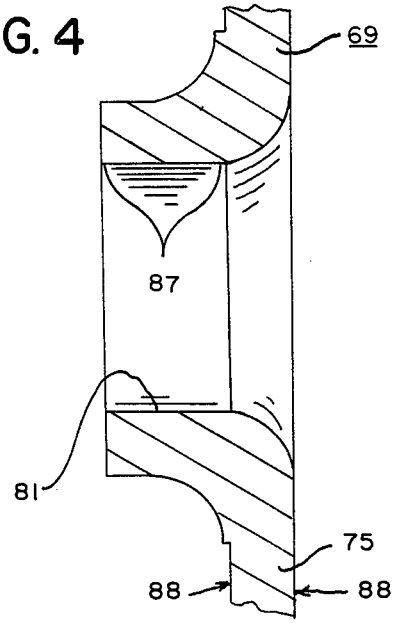
FIG. 4 is an enlarged sectional partial view showing the results of an application of the upset technique in forming the aperture which is provided in the elongated plate like link member, with the view being taken as on a vertical plane through the center line of the link member.

Particular attention is now directed toward FIG. 4 of the drawings where it may be seen that the link aperture 81 provided in the elongated plate like link member 69 is established by an "upset" technique in a manner well known to those skilled in the art. In other words, the "upset" technique forms a bearing surface, as at 87 for engagement with the second pin member 65 of the pin means 49 which inherently possesses a greater dimensional thickness than does the remaining portion of the link member 69, i.e., as shown by the arrows 88. As heretofore pointed out link member 71 is identical to link member 69 so that link aperture 81' is formed in a similar manner to aperture 81.

From FIG. 3 of the drawings it may be seen that the linkage means 47 includes pin retainer means generally indicated at 89 for preventing inadvertent withdrawal of the pin means 49 from the rod and link apertures 53, 55; 83, 85 respectively.

Figure 6:
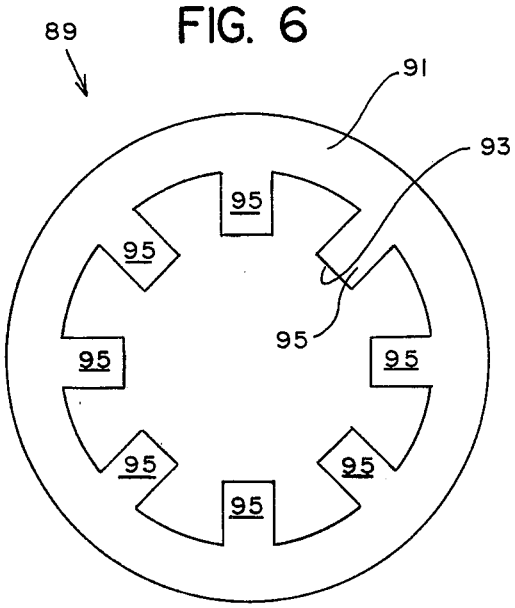
FIG. 6 is an enlarged elevational view of the pin retainer means or spring-clip like threadless speed nut which is used in holding the pin means of the present invention.

More specifically, in referring to FIG. 6 of the drawings it may be seen that the pin retainer means 89 includes at least one spring-clip like threadless speed type nut, as at 91, which is provided with an aperture, as at 93, that is slightly smaller in diameter than is either of the pin members 63, 65. It may readily be seen that the aperture 93 is defined in part by a plurality of inwardly directed resilient finger-like gripping members 95 that may yieldably be biased away from the plane of the speed nut 91. Thus, the speed nut 91 may readily be urged onto the end of either of the first and second pin members 63, 65 in a manner well known to those skilled in the art. Although, the gripping members 95 effectively impede the removal of the speed nut 91, thus inadvertent withdrawal of the pin means 49 is obviated.

From the foregoing it will be seen that the improved linkage means 47 of the present invention will last much longer than previous devices which had a pair of pins respectively through apertures 53, 55 and 83, 85. Thus, instead of deep grooves being cut into the pins by the relative movement of the pins which had a tendency to rotate back and forth as the lever 43 was moved back and forth in prior devices the pin members 63, 64 of the present invention can not move relative to the lever 43 so that grooves can not form from lever 43 acting on pin members 63, 65 since there is no relative movement between the parts. Also, the only relative movement at pin member 63 is at the broad or wide bearing surface of rod 33 defining aperture 51. In addition, there is only limited movement between link members 69, 71 and pin member 65, and the effect of such movement is compensated for by the bearing surfaces formed by the "upset" in the link members 69, 71 at the apertures 81, 81'.

Although the invention has been described and illustrated with respect to a preferred embodiment thereof, it should be understood that it is not intended to be so limited since changes and modifications may be made therein which are within the full intended scope of the invention.

I claim:

1. The combination with a liquid transfer hand operated pump of the double acting type having a housing provided with inlet and outlet ports, inlet and outlet check valve means respectively disposed within said housing adjacent said inlet and outlet ports, said housing defining an inner chamber interposed between said inlet and outlet check valve means, a reciprocatable rod extending through an aperture provided in said housing and having an outer end disposed on the exterior thereof and an inner end reaching into said inner chamber, means attached to said inner end of said reciprocatable rod for alternately varying the effective volume of said chamber as said reciprocatable rod is caused to reciprocate so as to cause the liquid within said chamber to be forced outwardly from said outlet port, and lever means adapted to be manually grasped when operating said pump; linkage means for coupling said lever means to (1) said housing, and (2) to said outer end of said reciprocatable rod; said linkage means comprising pin means about which said outer end of said reciprocatable rod means is free to pivot and including means for precluding relative pivotal movement between said lever means and said pin means, although said pin means is freely received in aligned rod apertures provided in said outer end of said reciprocatable rod and said lever means; said pin means including first and second parallel spaced apart pin members rigidly fixed one with the other, said first pin member being freely received through the rod apertures provided in said lever means and said reciprocatable rod, thus said rod being pivotally attached to said lever means, and said linkage means including at least one elongated plate-like link member having distal and proximal ends thereto with said distal end thereof being pivotally attached to said housing, said proximal end of said elongated plate-like link member being provided with a link aperture for pivotally receiving said second pin member of said pin means, said lever means also being provided with a link aperture for receiving said second pin member of said pin means, thus either end of said elongated plate-like link member is free to pivot while relative pivotal movement between said lever means and said pin means remains absolutely impossible, although said first pin member of said pin means is freely received in said rod apertures of said lever means and said reciprocatable rod and said second pin member of said pin means is freely received in said link apertures of said lever means and said link member.

2. The combination as set forth in claim 1 in which said link aperture provided in said elongated plate-like link member is established by an upset technique thus forming a bearing surface for engagement with said second pin member of said pin means which inherently possesses a greater dimensional thickness than does the remaining portion of said link member.

3. The combination as set forth in claim 1 in which is included pin retainer means for preventing inadvertent withdrawal of said pin means from said rod and link apertures.

4. The combination as set forth in claim 3 in which said pin retainer means includes at least one spring-clip-like threadless speed type nut which is provided with an aperture that is slightly smaller in diameter than is either of said pin members, said aperture being defined in part by a plurality of inwardly directed resilient finger-like gripping members that may yieldably be biased away from the plane of said speed nut, thus enabling said speed nut to readily be urged onto the end of either of said first and second pin members, although said gripping members effectively impede the removal of said speed type nut, thus inadvertent withdrawal of said pin means is obviated.

* * * * *